US005122083A

United States Patent [19]

Watanabe et al.

[11] Patent Number: 5,122,083

[45] Date of Patent: Jun. 16, 1992

[54] RESILIENT TERMINAL WITH BUCKLING PREVENTION MECHANISM

[75] Inventors: Mitsugu Watanabe; Nozomi Kawasaki; Masaaki Sugiyama; Yoshihisa Natsume, all of Kosai, Japan

[73] Assignee: Yazaki Corporation, Tokyo, Japan

[21] Appl. No.: 698,346

[22] Filed: May 7, 1991

Related U.S. Application Data

[63] Continuation of Ser. No. 460,498, Jan. 3, 1990, abandoned.

[30] Foreign Application Priority Data

Jan. 25, 1989 [JP] Japan ..... 1-6399[U]
Nov. 10, 1989 [JP] Japan ..... 1-130553[U]

[51] Int. Cl.[5] ..... H01R 13/11
[52] U.S. Cl. ..... 439/787; 439/850
[58] Field of Search ..... 439/787, 845, 849, 850, 439/723, 724

[56] References Cited

U.S. PATENT DOCUMENTS 2,514,336 7/1950 Paige ..... 439/787
4,221,456 9/1980 Cairns et al. ..... 439/787
4,472,017 9/1984 Sian ..... 439/850

*Primary Examiner*—Gary F. Paumen
*Attorney, Agent, or Firm*—Armstrong, Nikaido, Marmelstein, Kubovcik & Murray

[57] ABSTRACT

A resilient terminal with a buckling prevention mechanism has a pair of electric contact portions that are interconnected through a flexible joint portion. The pair of contact portions are provided with abutment portions that are disposed opposite to each other with a small gap therebetween. When there is a misalignment between the mating terminals or when an excessive insertion force is applied, the flexible joint portion of the terminal deflects to allow the male terminal to be inserted therein. The flexible joint portion, however, is protected against buckling because an excess bending of the joint portion is blocked by the abutment portions abutting against each other. At the same time, one of the abutment portions slides on the other, correcting the terminal misalignment and ensuring reliable terminal engagement.

3 Claims, 4 Drawing Sheets

RESILIENT TERMINAL WITH BUCKLING PREVENTION MECHANISM

This application is a continuation of application Ser. No. 460,498 filed Jan. 3, 1990, now abandoned.

BACKGROUND OF THE INVENTION

1. Field of the Invention

The present invention relates to a resilient terminal with a buckling prevention mechanism, which has a pair of electric contact portions and which prevents faulty engagement and deformation of terminals that would result from a center line deviation between mating terminals.

2. Description of the Prior Art

FIG. 10 is a perspective view of a conventional resilient terminal. The resilient terminal 11 has both sides of the base portion 12 bent toward each other to form a pair of binocular-shaped female contact portions 13*a*, 13*b*. The base portion 12 between the pair of electric contact portions 13*a*, 13*b* is narrowed to form a resilient joint portion 14.

FIG. 11 shows how the resilient terminal is used. The resilient terminal 11 is installed in a joint box 15 in an automobile. One of the electric contact portions 13*b* is connected with a busbar 16, and a tab-shaped male terminal 17 is inserted into the other electric contact portion 13*a*.

When the male terminal 17 is misaligned from the resilient terminal 11, the flexible joint portion 14 is bent as the male terminal 17 is inserted, thus allowing the terminal engagement. However, where the insertion force of the male terminal 17 is large or where said misalignment of the male terminal is excessive, the joint portion 4 which is structurally weak is buckled as shown in FIG. 12, rendering the connection of the two terminals impossible.

SUMMARY OF THE INVENTION

In light of the above problems, it is an object of this invention to provide a resilient terminal which will not buckle even when the insertion force of a mating terminal is large or in the event of excessive misalignment.

To achieve the above objective, this invention provides a resilient terminal with a buckling prevention mechanism, which basically comprises: a pair of electric contact portions arranged in a longitudinal direction, the contact portions being interconnected through a resilient joint portion; and abutments provided to the respective electric contact portions, said abutments being disposed in close facing relation to each other, said abutments lying substantially in a plane perpendicular to said longitudinal direction to face said resilient joint portion.

When an excess force is applied, in the terminal insertion direction, to the resilient terminal with a buckling prevention mechanism, the joint portion deflects until the abutments abut each other to prevent the joint portion from buckling. At the same time, one of the abutments slides on the other to correct the terminal misalignment, allowing reliable terminal engagement.

DESCRIPTION OF THE PREFERRED EMBODIMENTS

A resilient terminal with a buckling prevention mechanism according to this invention will be described.

Figure 1:
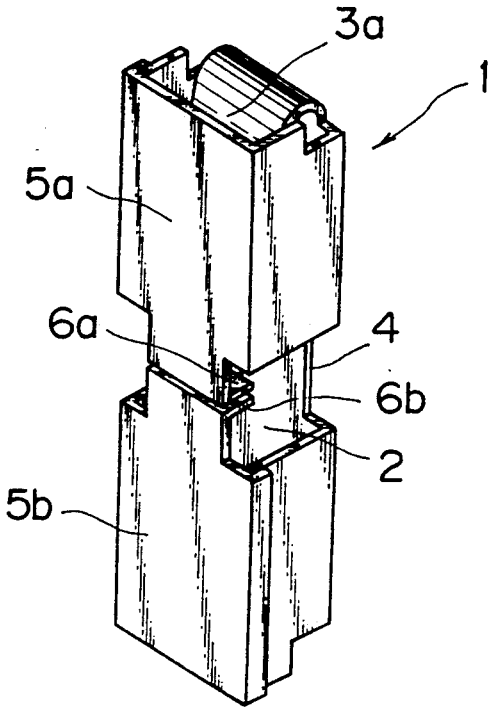
FIG. 1 is a perspective view of a terminal with a buckling prevention mechanism shown as a first embodiment of this invention.
Figure 2:
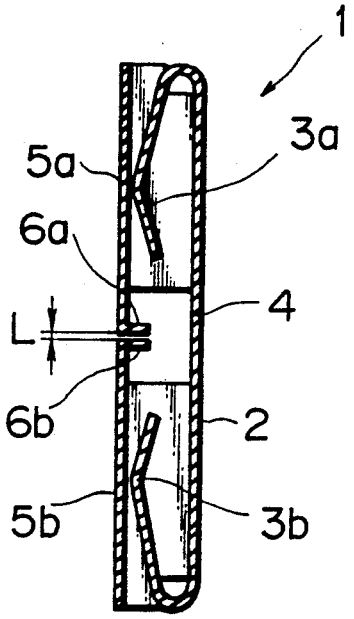
FIG. 2 is a vertical cross section of the first embodiment terminal.

FIG. 1 is a perspective view of the resilient terminal as one embodiment of the invention. FIG. 2 is a cross section of the terminal. The resilient terminal 1 with a buckling prevention mechanism has the ends of its base 2 folded inwardly to form tongue-shaped, resilient, electric contact pieces 3*a*, 3*b*. The central portion (joint portion 4) of the base 2 is narrowed in width to provide the base with resiliency when subjected to a bending force. A pair of terminal accommodating cases (electric contact cases) 5*a*, 5*b* are formed to extend from both sides of the base 2 so that they enclose the pair of electric contact pieces 3*a*, 3*b*. The pair of terminal accommodating cases 5*a*, 5*b* are provided with abutment pieces 6*a*, 6*b* that are disposed in close facing relation to each other. The pair of closely arranged abutment pieces 6*a*, 6*b* are spaced from each other by a gap L, which is small enough for the joint portion 4 to assure the limitation of resiliency when subjected to a bending force. The abutment pieces 6*a*, 6*b* are disposed to lie substantially in a plane perpendicular to said longitudinal direction to face said joint portion 4.

Figure 3:
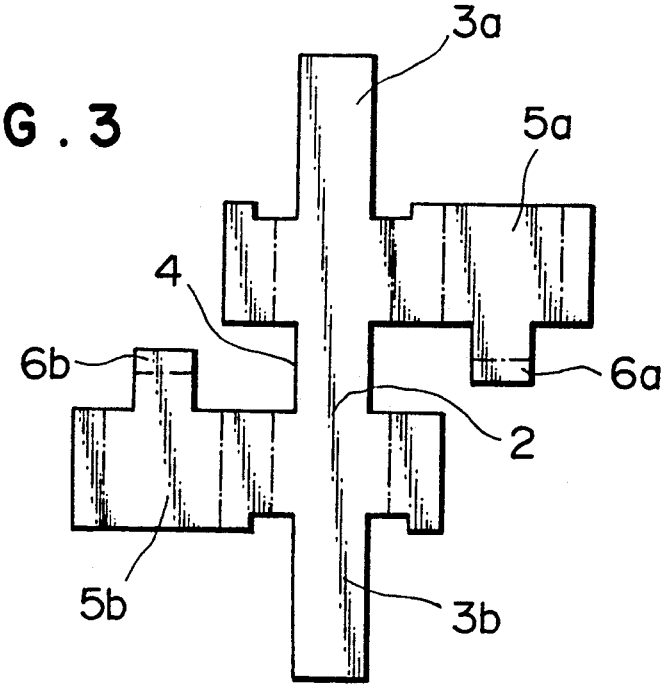
FIG. 3 is a development view of the first embodiment terminal.

FIG. 3 is a development view showing the buckling prevention mechanism-incorporated terminal 1 of FIG. 1 unfolded. A thin conductive metal plate is punched to form the base 2 of a shape as shown. Both longitudinal ends of the punched base 2 constitute electric contact pieces 3*a*, 3*b*; the central portion forms a narrow joint portion 4; and projecting symmetrically laterally at the upper and lower part of the base are those portions that will be formed into the terminal accommodating cases 5*a*, 5*b*. These portions for the terminal accommodating cases 5*a*, 5*b* are provided with inwardly projecting abutment pieces 6*a*, 6*b*.

Figure 4:
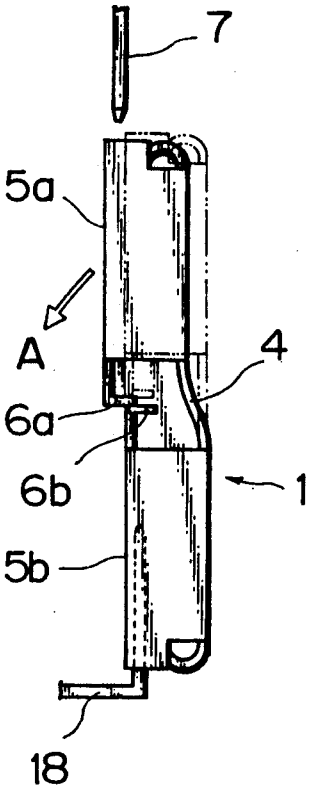
FIG. 4 is a side view showing how the first embodiment terminal works.

FIG. 4 is a side view showing how the resilient terminal 1 with the buckling prevention mechanism described above works. In the figure, reference numeral 7 denotes a tab-shaped male terminal. The resilient terminal 1 with the buckling prevention mechanism, which is installed in a joint box (not shown) and connected to a busbar 18, is greatly off-centered from the male terminal 7, as illustrated by a two-dot line which represents the condition of the resilient terminal before receiving the male terminal 7. In this condition, when the male terminal 7 is inserted, the terminal accommodating case 5a is forced by the incoming terminal 7 to rotate in an arc in a direction A about the base end of the resilient joint portion 4 as indicated by the solid line until the abutment pieces 6a, 6b contact with each other. Thus no buckling occurs at the joint portion 4. When the misalignment between the centers of these terminals is large. the abutment piece 6a on the male terminal insertion side slides on the other fixed abutment piece 6b to correct the center line misalignment.

Figure 6:
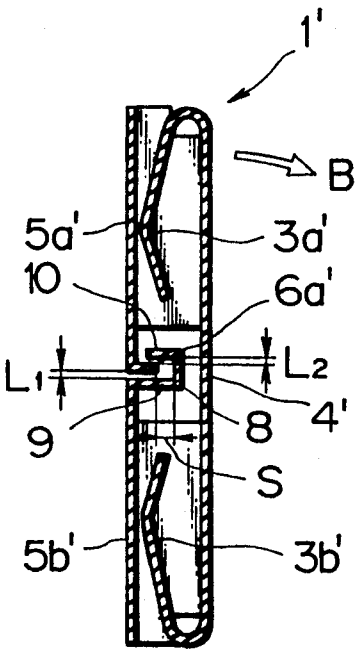
FIG. 6 is a vertical cross section of the second embodiment terminal.
Figure 5:
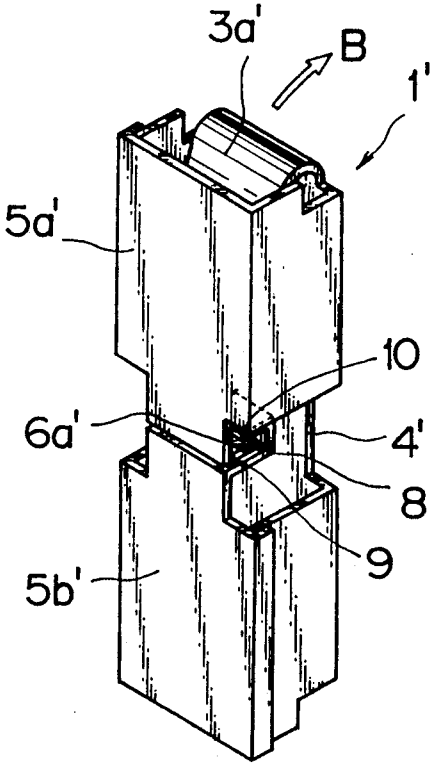
FIG. 5 is a perspective view of a resilient terminal as a second embodiment of the invention.

FIG. 5 is a perspective view of a second embodiment of this invention. FIG. 6 is a cross-sectional view of the second embodiment terminal. The resilient terminal 1' with a buckling prevention mechanism has, as in the preceding embodiment, electric contact pieces 3a', 3b', a joint portion 4' and terminal accommodating cases 5a', 5b'. The terminal accommodating case 5a' on the male terminal insertion side is formed with a flat abutment piece 6a' projecting perpendicular with respect to the case 5a'. The stationary terminal accommodating case 5b' is formed with a U-shaped engagement wall 8 disposed perpendicular to the case 5b' so that it encloses the first abutment piece 6a'. As in the first embodiment, said abutment 8 is positioned to lie substantially in a plane perpendicular to the longitudinal direction to face the joint portion 4'

The abutment 8 consists of a push abutment wall 9 and a pull abutment wall 10. The gaps $L_1$, $L_2$ between the engagement piece 6a' and the engagement walls 9, 10 are set almost equal. The push abutment wall 9 is formed longer than the abutment piece 6a' and the pull abutment wall 10 is formed to partly lap the abutment piece 6a'. In other words, a gap S is provided for the terminal accommodating case 5a' to move in the direction B. According to this embodiment, therefore, the terminal connection can be made smoothly in whatever direction the male terminal may be deviated.

Figure 10:
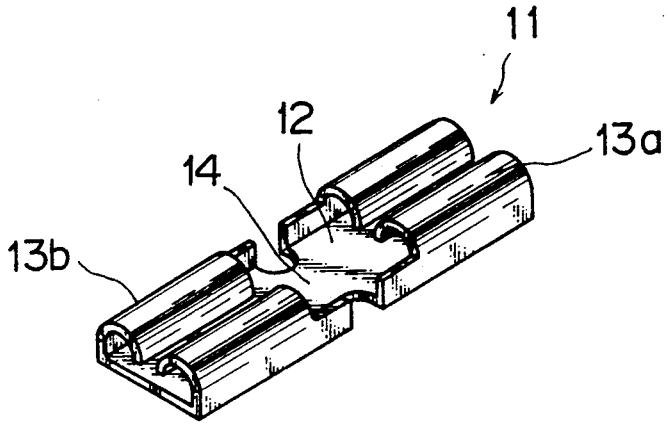
FIG. 10 PRIOR ART
FIG. 10 is a perspective view of a conventional terminal.
Figure 11:
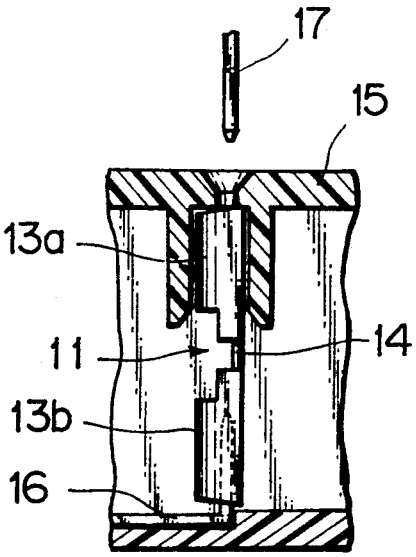
FIG. 11 PRIOR ART
FIGS. 11 and 12 are side views showing how the conventional terminal works.
Figure 12:
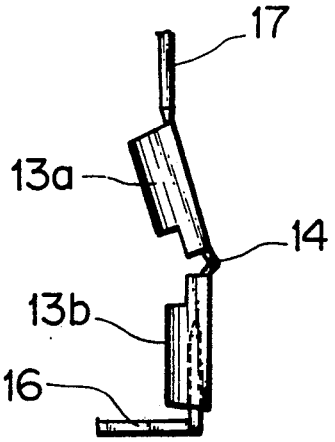
FIG. 12 PRIOR ART

In another embodiment, rather than using the tongue-shaped electric contact pieces 3a, 3b shown in FIGS. 1 and 2, it is possible to form binocular-shaped electric contact portions 13a, 13b as shown in the conventional terminal (FIG. 10) and form opposing abutment pieces 6a, 6b as shown in FIG. 1 on the electric contact portions 13a, 13b.

Figure 7:
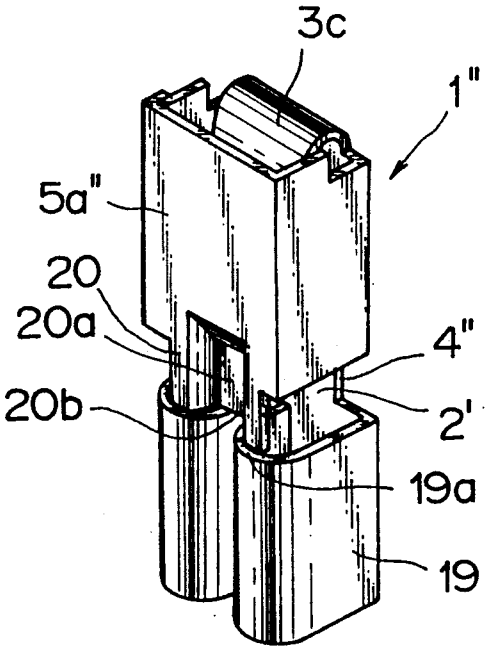
FIG. 7 is a perspective view of a resilient terminal as a third embodiment of the invention.

Furthermore, as shown in FIG. 7, the resilient terminal 1'' with a buckling prevention mechanism may have a tongue-shaped electric contact piece 3c at one end and, at the other end, a binocular-shaped electric contact portion 19.

In the resilient terminal 1'', the base 2' is formed with a tongue-shaped electric contact piece 3c at one end. At this end it also has a terminal accommodating case 5a'' that extends from the sides of the base 2' to enclose the contact piece 3c. The central portion of the base 2' is made narrow to form a resilient joint portion 4''. At the other end of the base 2' there is formed a binocular-shaped electric contact portion 19 which extends from both sides of the base 2' with side extensions curled toward each other. The terminal accommodating case 5a'' has an abutment piece 20 formed integral therewith, which is disposed close to and opposite to the end surface 19a of the binocular-shaped electric contact portion 19. The abutment piece 20 has an embossed groove 20a that extends longitudinally from its end. The embossed groove 20a is so formed that its front end surface 20b follows the contour of the end surface 19a of the curled portion of the electric contact portion 19. This is intended to increase the engagement area and thereby enhance the strength of the abutment piece 20.

Figure 8:
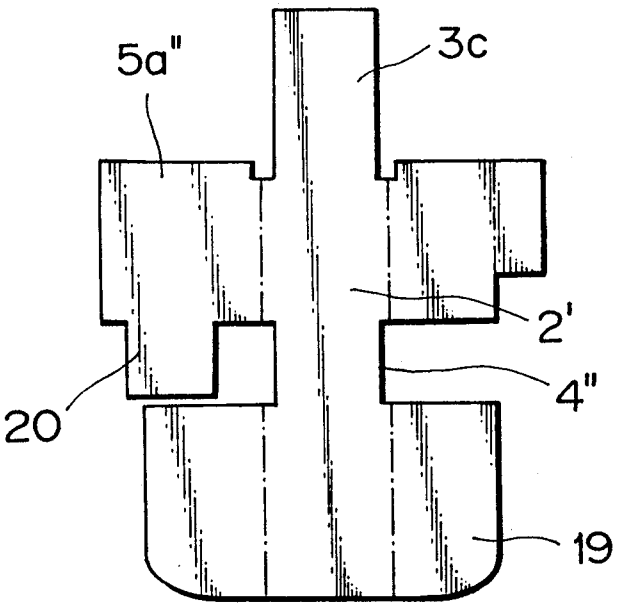
FIG. 8 is a development view of the third embodiment terminal.

FIG. 8 is a development view of the resilient terminal 1'' with a buckling prevention mechanism of FIG. 7. A conductive thin metal plate is punched to form the base 2' as shown. The upper end of the punched base 2' will constitute the tongue-shaped electric contact portion 3c. The laterally projecting portion at the middle of the base 2' will be formed into the terminal accommodating case 5a''. A portion projecting downwardly from the left side of the case 5a'' will form the abutment piece 20. The lower part of the base 2', which is connected to the case 5a'' through the narrow joint portion 4'' at the center, is the one to form the binocular-like electric contact portion 19.

Figure 9:
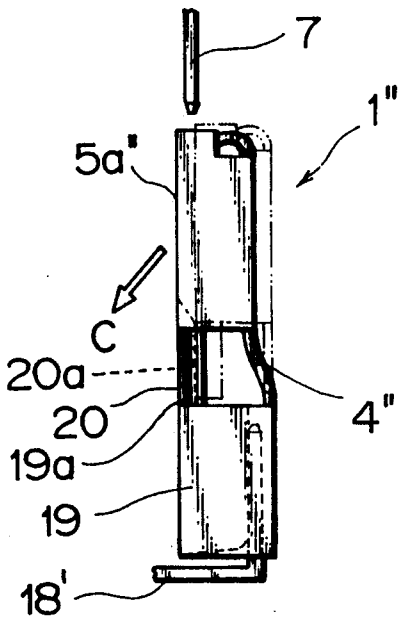
FIG. 9 is a side view showing how the third embodiment terminal works.

FIG. 9 is a side view showing the action of the resilient terminal 1'' that incorporates the buckling prevention mechanism described above. In the figure, reference numeral 7 is a tab-shaped male terminal. The buckling prevention mechanism-incorporated terminal 1'' connected to the busbar 18' is off-centered greatly from the male terminal 7, as indicated by a two-dot line that represents the condition of the terminal 1'' before insertion of the male terminal. In this state, when the male terminal 7 is inserted, the terminal accommodating case 5a'' is forced to move in the direction C about the base end of the resilient joint portion 4'' as indicated by the solid line until the abutment piece 20 abuts against the end surface 19a of the binocular-shaped electric contact portion 19 formed at the lower part of the base 2'. This prevents the buckling of the joint portion 4''. The abutment piece 20 is reinforced by the embossed groove 20a and thus will not be deflected.

As mentioned in the foregoing, when the terminal insertion force is large or when a male terminal is wrongly inserted, the resilient terminal according to this invention will not be buckled but ensures a reliable terminal connection, enhancing the connection work efficiency and the reliability of electrical connection.

What is claimed is:

1. A resilient terminal with a buckling prevention mechanism comprising:

a pair of electric contact portions arranged in a longitudinal direction, the contact portions being interconnected through a resilient joint portion; and an abutment provided on each of the respective electric contact portions, said abutments being disposed in very close facing relation to almost touch each other and lying substantially in planes perpendicular to said longitudinal direction to face said resilient joint portion and responsive to displacement of one of said electric contact portions relative to the other at the time of engagement thereof with a mating terminal to establish contact between the abutments and prevent further relative displacement between said electric contact portions.

2. A resilient terminal with a buckling prevention mechanism according to claim 1, wherein one of said abutments is further formed integrally with an engagement wall to enclose the other said abutment, said engagement wall including a push abutment wall formed longer than said other abutment and a pull abutment wall formed to overhang said other abutment.

3. A resilient terminal with a buckling prevention mechanism comprising:

a resilient joint portion formed at the middle of a conductive thin plate;

a pair of resilient contact pieces formed by folding both ends of the conductive thin plate;

a pair of terminal accommodating cases with each terminal accommodating case extending from one end of the conductive thin plate so as to enclose the corresponding resilient contact piece; and a pair of abutment pieces with each abutment piece being formed on a respective one of the pair of terminal accommodating cases in such a way that they lie in planes substantially perpendicular to the resilient joint portion and are disposed in very close facing relation to almost touch each other and are responsive to displacement of one of said terminal accommodating cases relative to the other at the time of engagement thereof with a mating terminal to establish contact between the abutment pieces and prevent further relative displacement between said terminal accommodating cases.

* * * * *